United States Patent [19]

Yoshii et al.

[11] Patent Number: 4,596,130

[45] Date of Patent: Jun. 24, 1986

[54] ROLLING MILL

[75] Inventors: Hisatoshi Yoshii; Hidekazu Watanabe; Osamu Takemoto; Hiromi Matsumoto, all of Fukuoka, Japan

[73] Assignee: Nippon Steel Corporation, Tokyo, Japan

[21] Appl. No.: 708,055

[22] Filed: Mar. 4, 1985

[51] Int. Cl.[4] ..... B21B 13/14

[52] U.S. Cl. ..... 72/241; 72/243

[58] Field of Search ..... 72/241, 243, 701, 242, 72/245

[56] References Cited

U.S. PATENT DOCUMENTS 4,519,233 5/1985 Feldmann et al. ..... 72/241

FOREIGN PATENT DOCUMENTS 21066 2/1978 Japan ..... 72/241

6562 2/1983 Japan ..... 72/241

*Primary Examiner*—Francis S. Husar

*Assistant Examiner*—Jorji M. Griffin

*Attorney, Agent, or Firm*—Cushman, Darby & Cushman

[57] ABSTRACT

A rolling mill stand in which at least one of the back-up rolls is given a convex crown around the roll body in an amount from 0.5 mm to 10 mm in diameter and at least one of the work rolls contacting the back-up rolls is given a concave crown around the roll body under the condition:

$$0.4 \times C_{BUR} \geqq C_{WR} \geqq 0.15 \times C_{BUR}$$

Also disclosed are mill arrangements in which at least one rolling mill stand of the above type is incorporated.

2 Claims, 16 Drawing Figures

| | | | | |
|---|---|---|---|---|
| Crown of Back-up Rolls | 0mm | 2.0 | 5.0 | 7.0 |
| Crown of Work Rolls | 0mm | -0.4 | -1.1 | -1.54 |

ROLLING MILL

BACKGROUND OF THE INVENTION

1. Field of the Invention

The present invention relates to a rolling mill for metal stocks, and more particularly to a rolling mill which over a wide range can control the plate crown.

2. Description of the Prior Art

In the rolling of a metal stock, such as a steel stock, the work rolls are subjected to a large rolling load which causes a deflection of the rolls, while the portion of the roll surface which is in contact with the rolling stock is forced to be flat. As the rolling thereon proceeds, the edges of the plate being rolled are extended sidewise so that the distribution of thickness of the rolled plate in the direction of the roll axis will be as shown in FIG. 1, leaving the thickest portion in the rolled center of the plate, which gradually becomes thinner toward the plate edges. This is the phenomenon of plate crown usually seen in the conventional rolling mill operation. The amount of the plate crown varies depending on the rolling variables, the thermal expansion of the rolls and the roll wear. It is most desirable that inconsistency in the amount of plate crown in final rolling mill products should be avoided because it will have adverse effects on the product quality and more particularly, the product yield. In FIG. 1 B represents the plate width, tM represents the thickness of the rolled center of the plate, tE represents the thickness of the plate edges, and the plate crown is represented by tM—tE.

In the event that the plate crown as stated above is substantially large and is generated once in the intermediate steps of a rolling operation, trials to correct the crown during the rolling process would be unsuccessful, resulting only in an undesirable wavy shape of the rolled plate, which would cause difficulties in the rolling operation. The resultant plate products are far from satisfaction with respect to the uniform distribution of plate thickness and the quality of plate flatness.

Conventionally, the following measures have been practiced in efforts to reduce or control the plate crown in the mill operation.

(1) A barrel like crown is given beforehand to the roll body.

(2) A concave or convex deflection is given to the upper or lower roll by means of a hydraulic cylinder and the like. This is called a roll bending method.

(3) Combination of the above (1) and (2).

(4) A rolling mill specially designed for controlling the crown is used; for example, in practice a sixhigh mill and a cross mill are used.

However, all of the above measures still have their own defects and disadvantages.

In the case of the measure (1) where the barrel-like crown is given beforehand to the roll body, it is practically impossible to give the roll body a proper crown beforehand which can meet with the rolling variables due to the fact that the width and thickness of the plate vary, the resistance of the plate being rolled to the deformation varies depending on the chemical compositions of the rolling stock and the rolling temperatures, and also the shape of the roll itself changes due to thermal expansion, wear and so on. Moreover, it is extremely difficult to modify and reduce the crown once caused in the plate without problems such as the occurrance of a wavy shape, namely with the assurance of maintaining a satisfactory quality of the plate flatness.

In the case of the measure (2) in which a convex or concave deflection is given to the upper and lower rolls by means of a roll bending device to modify the crown, an excessively large bending force cannot be applied in the conventional plate rolling mill because of the practical limits imposed by the strength of the roll necks, the life of the bearings and so on. Further, as the work rolls and the back-up rolls come into contact with each other along almost the entire length of the rolls, and the work rolls are subjected to an excessive moment of bending by the back-up rolls on the marginal portions outside the edges of the plate being rolled, the bending effect on the work rolls are off-set so much. For these reasons, the bending effect on the work rolls is prevalent only along and in the vicinity of the plate edge portions, and thus no substantial effect can be obtained upto the rolled center of the plate being rolled.

Also in the case of the measure (3) which combines the measures (1) and (2), no satisfactory controlling effect on the plate crown can be obtained, thus failing to withstand changes of the plate crown due to a variation in the resistance to deformation of the rolling stock, variation in the plate width, thermal expansion of the rolls, and roll wear as explained in connection with the measure (1).

In the case of the measure (4), a marked controlling effect can be obtained, but the problem in this case is that the capital cost is enormously high and it would be quite difficult to modify the existing mills so as to meet this purpose.

In order to reduce or control the plate crown according to the measure (1), as disclosed in Japanese Patent Publication No. Sho 59-35283, a large convex crown is given to the back-up rolls 2, 2' in contact with the work rolls 1, 1' as shown in the accompanying FIG. 2, whereby the work rolls are deformed by the bending moment as caused by the contact load imposed by the back-up rolls so that the rolling stock is prevented from being substantially reduced at the edge portions.

Also the roll bending effect by the roll bending device 4, 4' is remarkable because the edges of the work rolls are not restrained as clearly disclosed, for example, in Japanese Patent Application Nos. Sho 49-84209 and 50-18864. However, in actual rolling mill practices, various widths of plates are rolled, so it is very important to guarantee the desired bending effect as mentioned above for any width of plate. FIG. 3 shows the controllability range of plate crown defined by roll deformation under uniform force (herein called the controllability range of plate crown under uniform force) obtainable by various crown values given to the back-up rolls.

The term "the plate crown under uniform force" herein used means a calculated plate crown from the plate thickness distribution defined by the shape of work rolls determined by the deformation of the rolls caused by the load acting on the rolls imposed by the mill stand, which load is assumed to be distributed uniformly across the width of the plate being rolled. This calculated plate crown is not identical to the actual plate crown, but is very useful for relative comparison of the plate crown controllability of rolling mills.

While a wider controllability range of plate crown under uniform force can be obtained by a larger convex crown given to the back-up rolls, the ordinary crown control cannot be achieved if the plate width is too large, because the plate crown controllability range shifts to the minus side (concave crown), as shown in FIG. 3.

Due to the above problem, a large convex crown could not conventionally be given to the back-up rolls. According to the results of one trial in giving a small convex crown of about 1.0 mm to the back-up rolls, the controllability range of plate crown under uniform force could not cover all of the variable widths of plates, thus substantially limiting the practical plate crown control.

Although it is also known to give a convex or concave crown shape of about 0.1 mm in diameter to the work rolls, it has never hitherto been known to correlate the crown amount given to the work rolls with the crown amount given to the back-up rolls.

The problems of the prior art of giving the crown only to the work rolls have already been discussed.

SUMMARY OF THE INVENTION

One object of the present invention is to provide a rolling mill which can effectively control the plate crown in plate rolling by overcoming the problems of the conventional arts in reducing and controlling the plate crown as aforementioned.

The gist of the present invention lies in that a convex roll crown $C_{BUR}$ of 0.5 to 10 mm in diameter is given to at least one back-up roll which is in contact with one of a pair of upper and lower work rolls and a concave crown $C_{WR}$ is given to at least one of the work rolls under the condition;

$$0.4\times C_{BUR}\geqq C_{WR}\geqq 0.15\times C_{BUR}$$

whereby an effective plate crown control can be made for all various widths of plates to be rolled.

BRIEF EXPLANATION OF THE DRAWINGS

FIGS. 8*a*, 8*b*, 8*c*, 8*d* and 8*e* are illustrations of various crown shapes provided by the apparatus of this invention.

DETAILED DESCRIPTION OF THE INVENTION

The present invention will be more clearly understood from the following description made with reference to the accompanying drawings.

An investigation as to the controllability range of plate crown under uniform force was carried out by the present inventors for various widths of plates using a hot strip tandem mill, and it was found that when the work rolls are given an appropriate concave crown complementing or corresponding to the convex crown given to the back-up roll, the problems of the prior arts could be solved.

Figure 4:
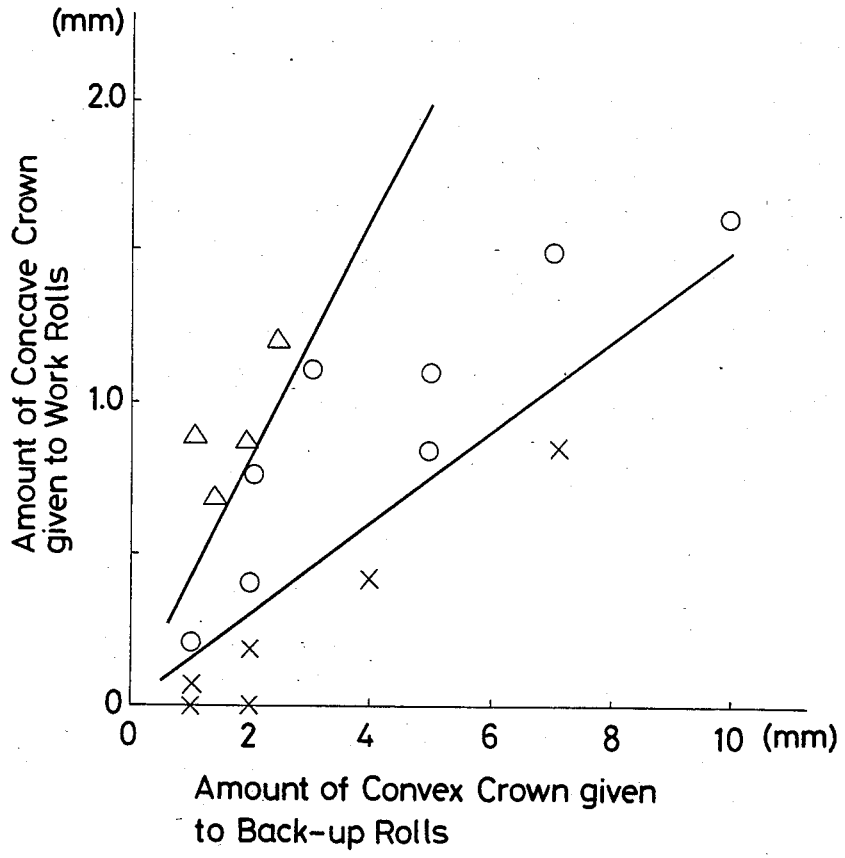
FIG. 4 illustrates a proper range of crown given to the back-up roll and work rolls according to the present invention.

The results of the experiments made using the hot strip tandem mill with different roll crowns are shown in FIG. 4. In the drawing, the evaluations of the controllability range of plate crown under uniform force are: O represents satisfactory results, X represents the range being on the minus side and Δ represents the range being excessive on the plus side when the plate width is considerably wide. It is understood from FIG. 4 that if the concave crown of the work rolls is small, the resultant plate crown will be concave for a large width of plate, and on the other hand if the concave crown of the work rolls is too large, the plate crown controllability range will be excessively biased on the plus side.

Thus as shown in FIG. 4, there is a proper range for the amounts of the crown given to the back-up roll and work roll, and the following conditions must be satisfied:

$$0.40\times C_{BUR}\geqq C_{WR}\geqq 0.15\times C_{BUR} \quad (1)$$

wherein $C_{WR}$ is an absolute value of the concave crown of the work roll, and $C_{BUR}$ is an absolute value of the convex crown of the back-up roll.

Figures 5, 8:
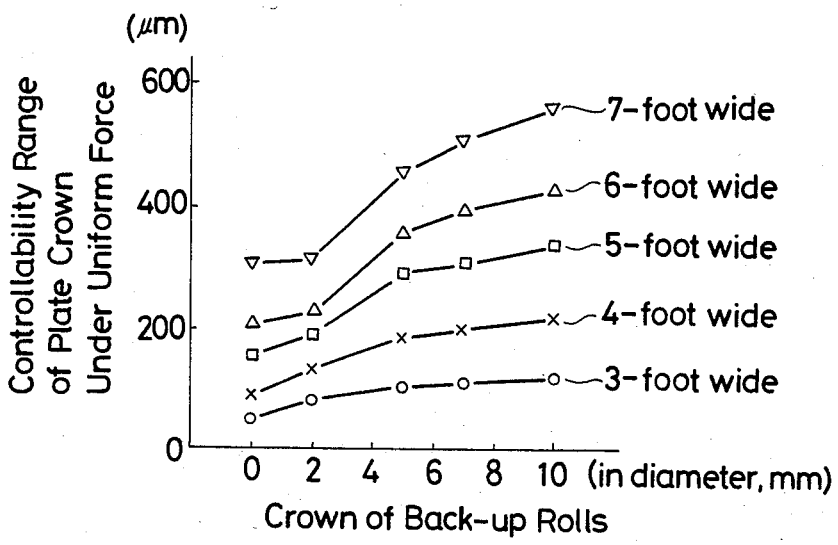
FIG. 5 shows the relation between the controllability range of plate crown under uniform force and the amount of convex crown of the back-up roll.
Figure 6:
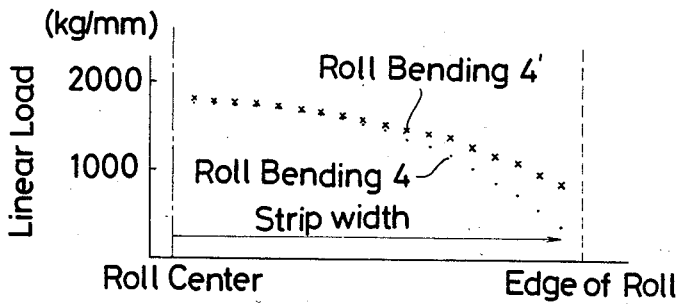
FIG. 6(*a*) shows the distribution across the plate width of the contact stress between the work roll and the back-up roll, and FIG. 6(*b*) shows the relation between the maximum Hertz's stress and the amount of the convex crown of the back-up roll.
Figure 6:
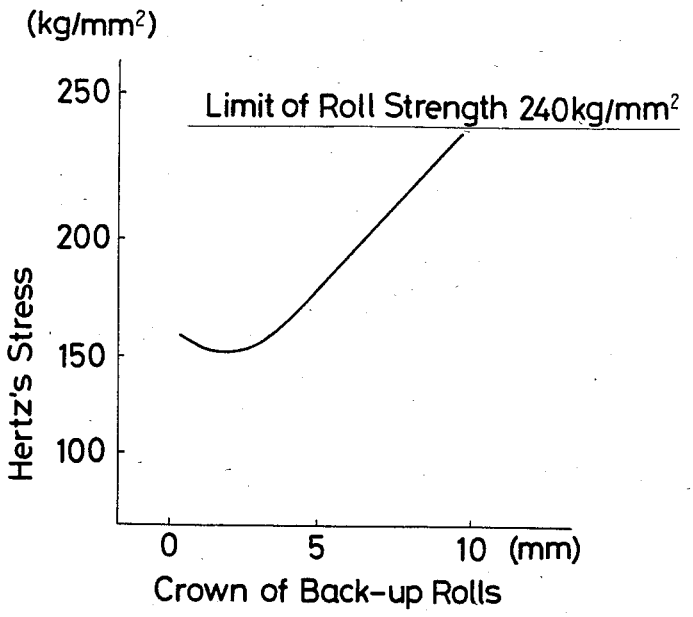

As shown in FIG. 5, an increased amount of the convex crown given to the back-up roll will expand the controllability range of plate crown under uniform force, but the increased amount will cause a contact stress, (Hertz's contact stress), between the back-up rolls and the work rolls as shown in FIG. 6, and the maximum linear load is imposed on the rolled center of the plate as shown in FIG. 6(*a*), so that spalling will very readily occur. In these experiments, the roll bending force applied is 90 tons and the strip width used is 7 feet. Therefore, the amount of the maximum convex crown given to the back-up roll is naturally limited by the spalling limit, but this maximum crown amount limited by the spalling limit will, needless to say, be increased as the width of the plate being rolled increases.

When the rolling is done for various widths of plates, it is advantageous from the point of expanding the crown controllability range that a larger amount of convex crown is given to the back-up rolls, thereby a larger roll bending effect is simultaneously obtained. However, from the restriction imposed by the spalling limit, the maximum convex crown amount admitted to the back-up roll is determined by the spalling limit in the rolling of a maximum width of a given mill capacity.

As shown in FIG. 6(*b*), the limit for the maximum crown amount beyond which the spalling is caused is about 10 mm. Therefore, the range of the convex crown given to the back-up roll should be not larger than 10 mm in diameter in view of the crown control effect and the spalling limit of the rolls.

In the conventional four-high plate mill, the back-up rolls are given a convex crown in view of the type of roll wears and other factors, but the crown in this case is about 0.2 mm at the largest point. And in this conventional four-high mill in the case of a plate of 3 feet width, the controllability range of plate crown under uniform force is 50 μm or less.

In the modern strip rolling mills, it is required to control the plate crown of hot strip mill product in the range from 0 to 60 μm so as to meet with the requirements of the subsequent cold rolling operation, and for this purpose the controllability range of plate crown under uniform force for each stand of the hot strip rolling tandem mill must be at least 60 μm with respect to a 3-foot width of plate. To achieve this range, a convex crown of at least 0.5 mm in diameter must be given to the back-up rolls.

Also in the conventional four-high rolling mill, the work rolls are given a convex or concave crown shape of about 0.1 mm in diameter in view of the wear and thermal expansion of the rolls.

In the present invention, the work rolls are given a large concave crown ranging from $0.15\times C_{BUR}$ to $0.4\times C_{BUR}$ in diameter depending on the magnitude of the convex crown given to the back-up roll.

Figure 7:
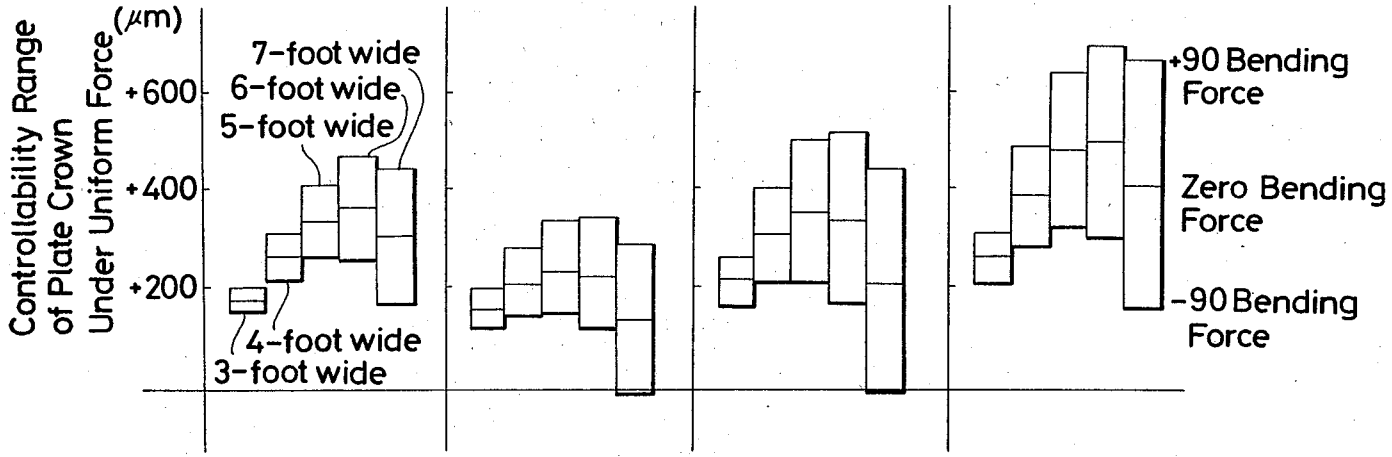
FIG. 7 shows the controllability range of plate crown under uniform force for various widths of plates obtainable by rolling with the convex crowned back-up rolls and concave crowned work rolls according to the present invention.

In FIG. 7 the controllability ranges of plate crown under uniform force from which the actual plate crown can be controlled to the range from 0 to 60 μm are shown. As shown a larger width of plate provides a wider controllability range.

DESCRIPTION OF THE PREFERRED EMBODIMENT

Figure 1:
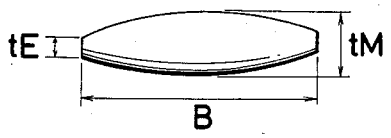
FIG. 1 shows a cross section across the width of a crowned plate.
Figure 2:
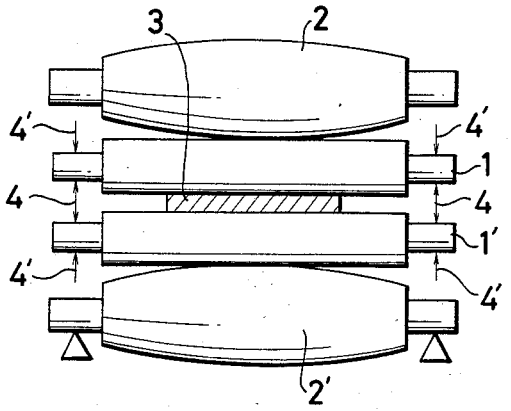
FIG. 2 shows one example of a rolling mill stand in which the back-up rolls are given a convex crown.
Figure 3:
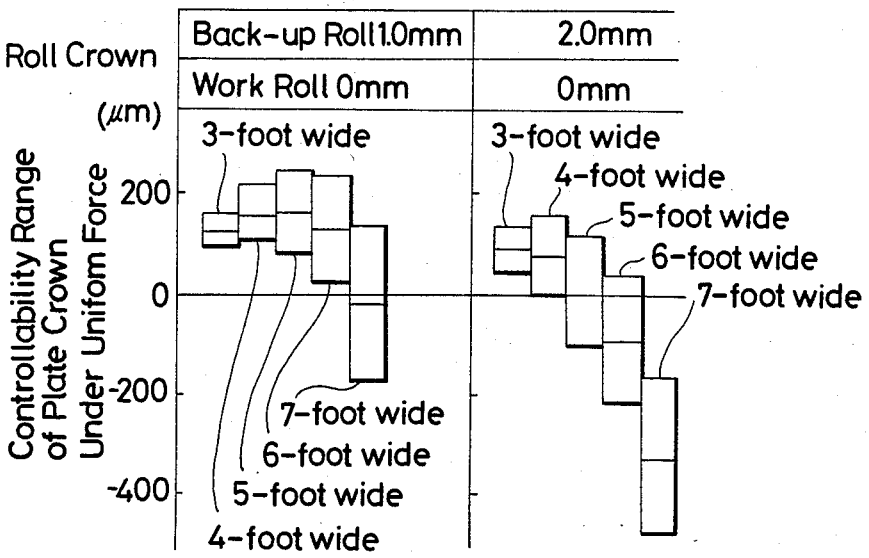
FIG. 3 illustrates the controllability range of plate crown under uniform force for various widths of plates achieved by the mill shown in FIG. 2.

The controllability ranges of plate crown under uniform force achieved by the work and back-up rolls with appropriate crowns according to the present invention are shown in FIG. 7 in comparison with those achieved without giving the crown to the back-up rolls. As understood from FIG. 7, when an appropriate concave crown satisfying the condition (1), depending on the magnitude of the convex crown given to the back-up rolls, a proper controllability range can be obtained for various widths of the plates being rolled, whereby problems such as the crown being controlled only on the minus side as shown in FIG. 3 can be eliminated and the controllability range of plate crown under uniform force can be expanded substantially.

Regarding the shape of the roll crown, various shapes such as crowns formed by straight lines (a), (b), a sine curve (c), and a parabola (d) shown in FIG. 8 may be used. Regarding the crown shape of the work rolls, a concave crown shape complementary to the convex crown shapes of the back-up rolls shown in FIG. 8 may be used. However, as the work rolls are directly in contact with the rolling stocks, the crown shape as shown by (a), (b) and (e) in FIG. 8 are not desirable.

The desired results of the present invention can be obtained also by a rolling mill arrangement in which an intermediate roll is mounted between the work roll and the back-up roll, and the intermediate roll is given a convex crown and the work roll is given a concave crown corresponding to the magnitude of the convex crown of the intermediate roll.

According to the present invention, in cases where the rolling is done covering from the minimum to the maximum widths of the final plate mill products which are determined by the mill arrangements, an effective controllability range of plate crown under uniform force can be guaranteed for various widths by giving a convex crown to the back-up roll which is in contact with the work roll and giving a concave crown to the work roll depending on the magnitude of the convex crown of the back-up roll, and at the same time a remarkable plate crown controlling effect is obtained by the roll bending.

When the present invention is applied to a hot strip rolling, a mill arrangement in which 6 to 7 stands are arranged adjacent each other is usually used. In this mill arrangement, the work rolls and back-up rolls of at least one stand are given the crown configurations as defined in the present invention so as to control the plate crown of the final mill products. If the number of the stands in which the rolls are given the crown configurations according to the present invention is increased, the controlling capacity and ability are so much increased.

Figure 9:
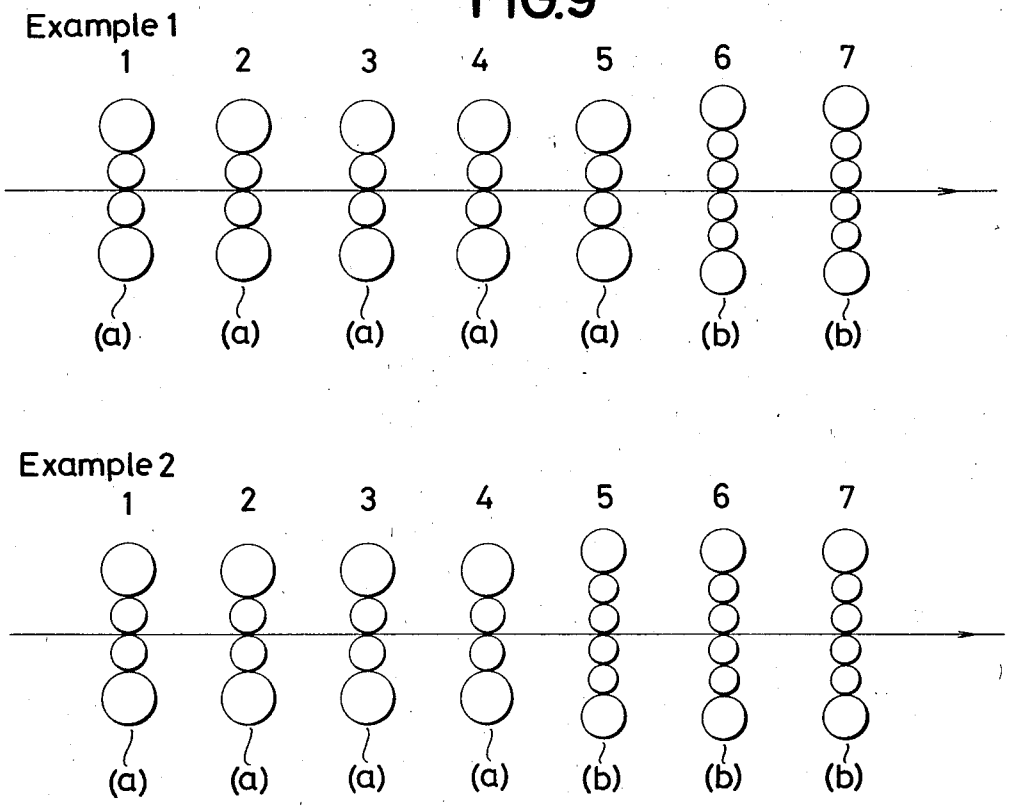
FIG. 9 illustrates embodiments of rolling mill arrangements according to the present invention.
Figure 11:
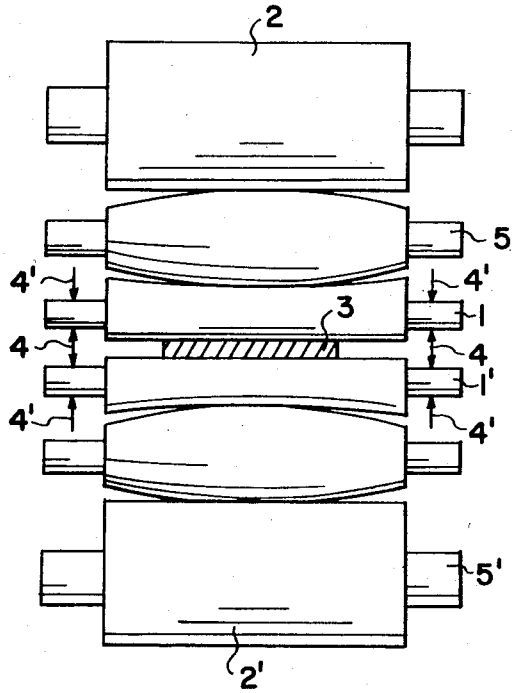
FIG. 11 is an example of another embodiment of this invention.
Figure 10:
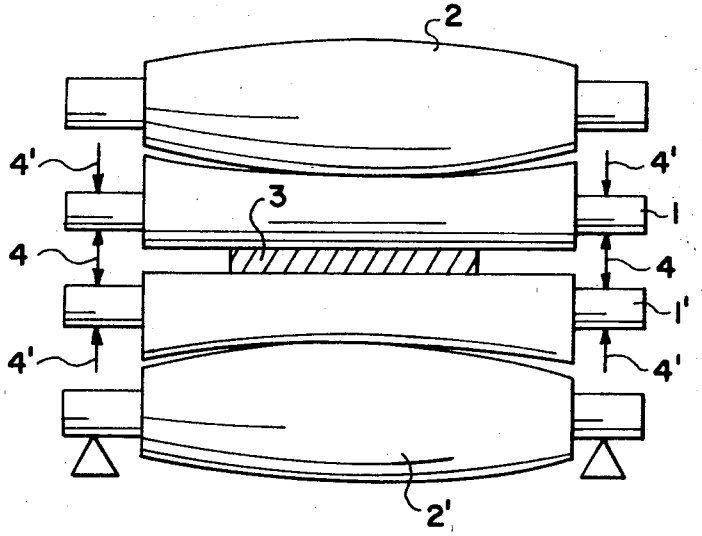
FIG. 10 shows an example of a rolling mill stand of this invention.

Example of the mill arrangements composed of seven stands are illustrated in FIG. 9. The particulars of the mills are set forth below. In the roll stands designated (a) the rolls are crowned according to the present invention. The roll stands designated (b) are conventional ones specially designed for the crown control.

TABLE

| Mill Type | Modified Four-high | Rolling Mill |
|---|---|---|
| Back-up Rolls | Diameter | 1600 mm |
| | Barrel length | 2250 mm |
| Work Rolls | Diameter | 790 mm |
| | Barrel length | 2250 mm |
| Roll Bending | Increase | 90 t |
| | Decrease | 90 t |

| No. of Stand | Roll Crown $C_{BUR}$(mm) | $C_{WR}$(mm) |
|---|---|---|
| 1 | 3.0 | 0.7 |
| 2 | 3.0 | 0.7 |
| 3 | 2.0 | 0.5 |
| 4 | 2.0 | 0.5 |
| 5 | 2.0 | 0.3 |
| 6 | 2.0 | 0.3 |
| 7 | 1.0 | 0.2 |

The mill arrangements shown in FIG. 9 are used for the plate crown controlling of special grades of steel which are very rigid and difficult to control the plate crown.

As shown in FIG. 9, the conventional crown controlling rolling stands of high capital cost are arranged in the down-stream of the mill train, and the rolling stands according to the present invention are arranged in the up-stream of the train so that the capital cost as a whole is greatly reduced.

According to the present invention, the desired result can be obtained by only one stand as defined by the present invention incorporated in a mill comprising a plurality of stands. However, better results can be obtained by incorporating more than one stand according to the present invention.

As understood from the foregoing description of the present invention, the present invention has advantages such that it can be put into commercial practice at very low capital costs and can be applied to existing mills without having to be rearranged, and yet a marked plate crown controlling effect can be obtained. Further, the expanded range of the crown controllability achieved by the present invention greatly contributes to the reduction of the crown of final mill products and to the improvement of the plate thickness accuracy, hence improvements of the product quality and production yield. Further, according to the present invention, as the necessity of changing the crown of the work rolls in accordance with the sizes of rolling products to be rolled is eliminated, the frequency of the work roll changing is substantially reduced so that marked economical advantages can be obtained from the aspects of energy saving efficiency and mill productivity.

What is claimed is:

1. A rolling mill stand comprising:

a pair of upper and lower work rolls;

a pair of back-up rolls to back up the pair of work rolls; and a bending device for bending the work rolls;

at least one of said back-up rolls being given a convex crown around the roll body in an amount ranging from 0.5 mm to 10 mm in diameter;

at least one of said work rolls contacting said one of the back-up rolls being given a concave crown around the roll body under the condition:

$$0.4 \times C_{BUR} \geqq C_{WR} \geqq 0.15 \times C_{BUR}$$

wherein $C_{BUR}$ represents an absolute value of the crown in diameter of the back-up roll and $C_{WR}$ represents an absolute value of the crown in diameter of the work roll.

2. A rolling mill stand comprising:

a pair of upper and lower work rolls, a pair of intermediate rolls in contact with the pair of work rolls, a pair of back-up rolls to back up the pair of intermediate rolls, and a bending device for bending the work rolls, at least one of said intermediate rolls being given a convex crown around the roll body in an amount ranging from 0.5 to 10 mm in diameter, and at least one of said work rolls contacting one of said intermediate rolls being given a concave crown around the roll body under the condition:

$$0.4 \times C_{IR} \geqq C_{WR} \geqq 0.15 \times C_{IR}$$

wherein $C_{IR}$ represents an absolute value of the crown in diameter of the intermediate roll and $C_{WR}$ represents an absolute value of the crown in diameter of the work roll.

* * * * *